United States Patent [19]

Pierpont

[11] Patent Number: 4,984,702

[45] Date of Patent: Jan. 15, 1991

[54] ASSEMBLY FOR SECURING AND SEALING A DISPENSER TO A FLANGED CONTAINER

[75] Inventor: Robert Pierpont, Meriden, Conn.

[73] Assignee: Specialty Packaging Licensing Company, Inc., Wilmington, Del.

[21] Appl. No.: 501,853

[22] Filed: Mar. 30, 1990

[51] Int. Cl.[5] ..... B65D 47/00

[52] U.S. Cl. ..... 215/272; 215/274; 222/321

[58] Field of Search ..... 215/272, 274; 222/321, 222/385

[56] References Cited

U.S. PATENT DOCUMENTS

| | | | |
|---|---|---|---|
| 3,331,559 | 7/1967 | Fedit | 222/321 X |
| 4,173,297 | 11/1979 | Pettersen | 222/321 |
| 4,606,479 | 8/1986 | Van Brocklin | 222/321 |
| 4,615,465 | 10/1986 | Grothoff | 222/1 |
| 4,735,347 | 4/1988 | Schultz et al. | 222/321 |
| 4,773,553 | 9/1988 | Van Brocklin | 215/272 |
| 4,936,492 | 6/1990 | Amiel et al. | 222/207 |

FOREIGN PATENT DOCUMENTS

| | | | |
|---|---|---|---|
| 2534557 | 4/1984 | France | 215/272 |

*Primary Examiner*—Stephen Marcus
*Assistant Examiner*—Stephen K. Cronin
*Attorney, Agent, or Firm*—Dallett Hoopes

[57] ABSTRACT

This structure includes a resilient collar having a central boss with an opening which receives the discharge apparatus, such as a pump or valve. The collar fits over the flange of the container and has an outward protrusion in the form of fingers. A sleeve is sized to slide down over the side of the collar where it surrounds the flange and cams inwardly the protrusion to hold the collar on the container. The improvement relates to a re-entrant portion at the upper end of the sleeve which extends downward in an inner tube terminating at its lower end in a short inward annular flange which grips the sides of a central boss on the collar to keep the sleeve from being vertically displaced.

4 Claims, 1 Drawing Sheet

ASSEMBLY FOR SECURING AND SEALING A DISPENSER TO A FLANGED CONTAINER

BACKGROUND OF THE INVENTION

1. Field of the Invention

The present invention relates to an assembly for securing and sealing a dispenser, such as a pump, a valve or other dispensing means with respect to a flanged container. More particularly, the present invention relates to an assembly for securing a dispenser to a container without the necessity of complex mechanical operation.

2. Description of Related Art Including Information Disclosed under §§1.97 to 1.99

It is desirable to secure a dispenser such as a pump, a valve, or other dispensing means to a container for storing and dispensing a liquid product.

The U.S. Pat. No. 4,773,553, issued Sept. 27, 1988, to Van Brocklin, has, as it states, for an object to provide an assembly and a method for securing and sealing a dispenser with respect to the flange of a container in a simplified fashion which requires relatively unsophisticated equipment for assembly. That patent is quoted liberally herein. In accordance with one aspect of the Van Brocklin invention, it includes a sealing collar of a deformable material, preferably a resilient deformable material. The collar has a ring including a floor and a depending ring. The ring and rim are in contact with the upper surface and sidewall of the flange in the assembled position. The collar includes a protrusion preferably in the form of fingers depending from about the rim, and having a diameter of a size to receive the sidewall of the flange, and also able to be encased by the sleeve. The protrusion includes lower end portions on the fingers protruding outward in the path of movement of a mounting sleeve (called a "mounting cup" by Van Brocklin) as the unit is assembled. When the sealing collar and sleeve are assembled, the sleeve forces the protrusion inwardly to a position beneath the flange of the container thereby securing the collar to the flange. A frictionally held cap fits over the sleeve to complete the assembly.

With respect to the present invention, one of the drawbacks of earlier structures is that the plastic collar would, after a period of time, tend to "creep", that is, elongate and reduce somewhat in diameter, relieving outward pressure against the sleeve. As a consequence, occasionally and disastrously, as the user has tried to pull the cap upward off the sleeve, the sleeve has itself been pulled up off the collar. This, of course, has undermined the security of the collar itself on the flange of the container.

The Van Brocklin patent proposes several variations in structure to meet this problem.

SUMMARY OF THE INVENTION

The present invention is an improvement on the Van Brocklin invention. In accordance with the present invention the sleeve is formed at its upper end with a reentrant inner downward tube and an inward annular engagement flange is provided at the lower end of the inner tube. The top surface of the resilient collar is formed with an annular well or recess and a central boss in part defined by the inner wall of the recess. In assembly, the sleeve is brought down over the collar as described in the patent so that the protrusion on the collar (i.e. the fingers) are forced inward to seal the collar on the bottle flange. The sleeve when it is shoved downward to its fully assembled position has the lower end of the inner tube in the well with the inside edge of the annular engagement flange forceably gripping the bottom of the central boss. The flow of plastic to upward of the flange traps the flange and collar in assembled position. To enforce the gripping, the flange may be inclined slightly upward toward the center line.

BRIEF DESCRIPTION OF THE DRAWINGS

Other features and objects of the invention will be apparent to those skilled in the art from a review of the following specification and the drawings, all of which disclose a non-limiting form of the invention. In the drawings.

DETAILED DESCRIPTION OF THE INVENTION

Figure 1:
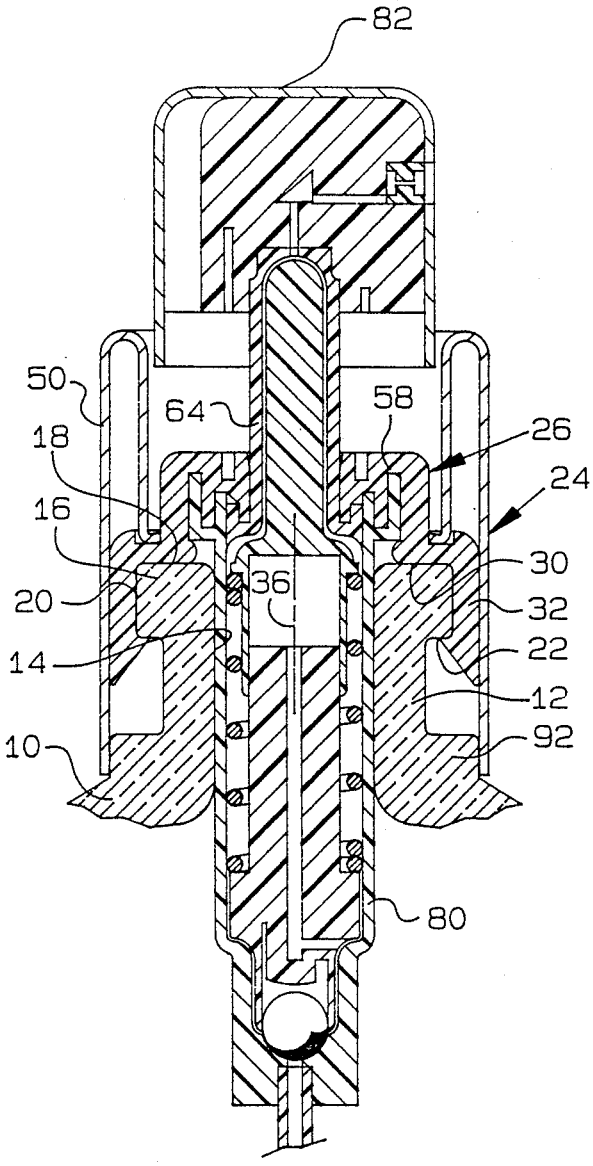
FIG. 1 is a sectional view taken along the common axis of the components of the assembly and showing the assembled components.

Referring to FIG. 1, an assembly embodying the invention is shown. It comprises a container 10 of the type having a neck 12 with an opening 14 for dispensing product stored in the container. The neck includes a flange 16 which presents an upper surface 18 surrounding the opening 14, a sidewall 20 about its periphery and an inwardly directed ledge 22 at the bottom of the flange. The container is typically made of glass, although other types of materials such as plastic or metal can be utilized. An assembly in accordance with the present invention is particularly suited for use with cosmetic containers such as those containing perfume.

An assembly in accordance with the present invention includes a mounting sleeve 24 and a sealing collar 26. The sealing collar 26 is formed of a deformable material, and preferably a resilient deformable material such as polyethylene, including linear low density polyethylene, rubber elastomers or vinyl. The sealing collar 26 includes a ring 28 having a floor 30 for contacting the upper surface 18 of the container flange. The collar 26 includes a protrusion 32 extending from the ring 28.

The protrusion 32 has an inner diameter when made to collapse inward sized to receive the sidewall of the flange 16, and preferably, the inner diameter of the protrusion is slightly less than the diameter of the flange wall to provide a snug, frictional fit. The protrusion 32 is preferably generally cylindrical and symetric with respect to axis 36.

The sealing collar 26 can be designed to receive any number of different types of dispensers including pumps, valves, shaker plug type valve, squeeze type valves, and pouring type valves. The collar includes a central opening 40 for receiving the dispenser, such as a pump, and includes other structures which are designed specifically for the type of dispenser to be used with the assembly. Thus, the portion of the sealing collar 26 above the ring is not described in detail inasmuch as it can be changed and adapted to various types of dispensers.

The end portion of protrusion 32 includes a radially outwardly protruding structure (FIG. 2) located in the path of movement of the mounting sleeve 24. More specifically, the protrusion includes a plurality of slots 44 about its periphery. The slots 44 define a plurality of deformable fingers 46 enlarged at their lower ends. It is preferred that the fingers 46 include an inclined camming surface 48 (See FIG. 2). When the sleeve 24 in assembly is moved downwardly it contacts camming surface 48 and forces each of the tabs radially inwardly. It is preferable that the sealing collar be of a molded polymeric material which can be formed in a single piece. Alternatively, if necessary, the collar could be formed in a plurality of pieces so long as the fingers 46 are deformable.

Figure 2:
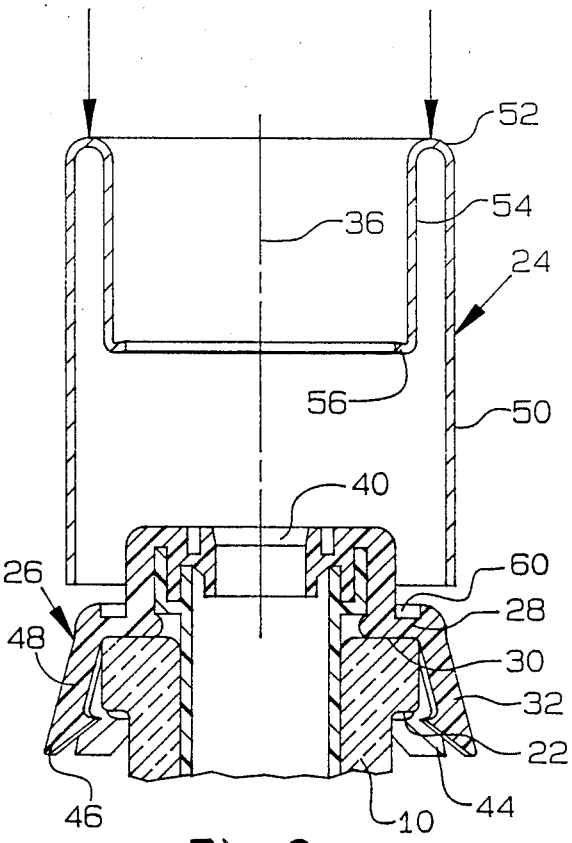
FIG. 2 is a sectional view of the collar and sleeve only during a step of assembly.

Referring to FIGS. 1 and 2, the mounting sleeve 24 will now be described in detail. The sleeve is preferably made of a material which is substantially rigid, such as metal, hard plastic, wood or glass. The cup 24 includes a skirt 50 which has a shape symmetric with respect to common axis 36. If desired, as stated, the inner diameter of the outer tube of the sleeve can be slightly less than the outer diameter of collapsed protrusion 32 so that the protrusion is slightly compressed between the flange sidewall 20 and the interior surface of the outer tube.

Figure 3:
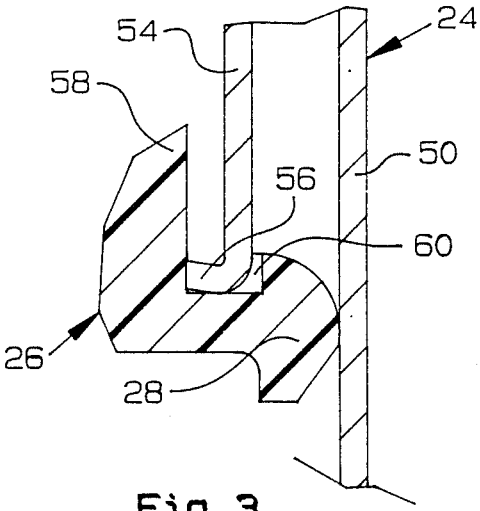
FIG. 3 is an enlarged fragmentary view showing the annular inward flange forceably engaging the central boss of the collar.

As shown in FIGS. 1 and 2, the outer tube 50 of the mounting sleeve 24 has at its upper end a reentrant portion 52 which extends downwardly in an inner tubular run 54. At its lower end the inner tubular run 54 is formed with an inward annular engagement flange 56. As best shown in FIG. 3, the inward annular engagement flange 56 may be canted slightly upward in its brief inward length.

The ring 28 of the collar is formed on its upper surface by a central boss 58 which is surrounded by an annular shallow well 60 (FIG. 2). The well 60 generally aligns with the outer margin of the top of the flange 16. The boss is, of course, provided with an opening 40 which receives the dispensing means such as the pump stem 64 (FIG. 1).

As shown in FIG. 2, in assembly with some force urging the sleeve 24 down (see arrows FIG. 2) with respect to container 10, the outer tube 50 contacts the camming surface 48 and forces the fingers 46 radially inwardly beneath ledge 22. It should be understood that by a "ledge" it is meant an inward slot or groove which is capable of receiving the enlarged lower ends of fingers 46. Thereafter, as the mounting cup 24 is forced "home" it deforms the fingers to collapse inward to the position shown in FIG. 1, holding the collar 26 securely in place.

With the mounting sleeve 24 in its "home" position (FIG. 1), the inward annular extension 56 is disposed about the bottom of the well 60 (FIG. 3). The inner distal edge of the flange 56 digs into the resilient plastic of the boss 58 of collar 26. Additionally, because the flange 56 is sized to be slightly smaller in diameter than the boss, the flange 56 forcibly engages the wall of the boss to help make the engagement more secure. Moreover, once the flange 56 is "home", the resilient material of the boss 58 resumes to normal diameter above the flange to provide a barely perceptible but effective overhang to trap the flange in the well and hold the mounting sleeve in its position shown in FIG. 1.

The assembly is completed by a cap (not shown) which fits over the mounting sleeve in the usual way.

FIG. 1 shows a spray pump 80 assembly securely and sealingly in place on the flange 16 of a container (not shown in full) using an assembly of the invention. The spray pump assembly is shown for purposes of illustration only as being typical of those known in the art. The pump is mounted on collar 26 as shown. The mode of operation of the assembly is similar to that shown in the aforesaid U.S. Pat. No. 4,173,297 of Petterson and will not be explained in detail, since such will be immediately apparent to one skilled in the art. The pump is actuated by manual depression of actuator 82.

A second flange 92 is disposed on the lower end of the outer surface of the neck of the container. The vertical sidewall of the second flange engages the inner surface of the lower end portion of the outer tube of the mounting sleeve 24. This engagement of the mounting sleeve with the sidewall of the second flange in assembly in the above manner serves to ensure that the mounting sleeve is properly aligned coaxially with the neck of container during the actual assembly of the components and that the components are maintained thereafter in correct alignment.

Under the present invention, the secure interfitting of the mounting sleeve 24 and collar 26 effected by the engagement of the flange 56 with the boss 58 (FIG. 3) assures that the mounting sleeve will not be displaced upward from the collar when the cap is removed off the sleeve. At the same time, the assembly of the present invention does not require any crimping in the mounting sleeve, or other indentations which would mar the otherwise smooth appearance of the installed mounting sleeve.

Variations of the structure shown in the drawings and discussed herein are possible. Hence, the invention is not limited to the embodiment shown. Instead, it is susceptible of modifications and variations. The invention is not of such limited scope, but may be defined by the following claim language and reasonable equivalents thereof.

What is claimed is:

1. In a container assembly comprising:

(1) a container having a neck with an opening for dispensing product, the neck having a flange including an upper surface surrounding the opening and a cylindrical sidewall about its periphery, said sidewall of said flange having a diameter and said neck including an inwardly directed ledge at the bottom thereof, the sidewall having a length which may vary within manufacturing tolerances, (2) a mounting sleeve comprising a substantially rigid material, said sleeve having an outer tube around its periphery, said sleeve slideable through a path of movement over said container flange to an assembled position, and (3) a sealing collar comprising a resilient deformable molded polymeric material, said collar having a central opening for receiving said dispenser, said collar including a generally cylindrical protrusion having a diameter sized to receive said flange sidewall and sized to be encased by said mounting sleeve outer tube, at least a portion of said protrusion when collapsed having an inner diameter less than said diameter of said flange sidewall to provide an annular area of contact between the protrusion and the flange sidewall in a snug, frictional fit therebetween, said protrusion including a plurality of fingers having enlargements at the bottom thereof and a camming surface protruding in said path of movement of said mounting sleeve for collapsing said protrusion, said enlargements deforming radially inwardly under said ledge, as said protrusion collapses, the improvement wherein the mounting sleeve is formed at its upper end with a reentrant inner tubular run and an inward annular engagement flange is provided at the lower end of the inward tubular run, and the top surface of the collar is formed with a central boss, the sleeve in assembly having the annular engagement flange frictionally engaging against the central boss.

2. A container assembly as claimed in claim 1 wherein the annular engagement flange slopes slightly upward.

3. A container assembly as claimed in claim 1 wherein the boss is surrounded immediately with an annular well and the engagement flange is disposed in the well.

4. A container assembly as claimed in claim 3 wherein the well is directly over the outer periphery of the flange.

* * * * *